US007212642B2

(12) United States Patent
Rasmussen

(10) Patent No.: US 7,212,642 B2
(45) Date of Patent: May 1, 2007

(54) MICROPHONE SYSTEM WITH DIRECTIONAL RESPONSE

(75) Inventor: Karsten Bo Rasmussen, Hellerup (DK)

(73) Assignee: Oticon A/S, Smørum (DE)

( * ) Notice: Subject to any disclaimer, the term of this patent is extended or adjusted under 35 U.S.C. 154(b) by 0 days.

(21) Appl. No.: 10/539,177

(22) PCT Filed: Dec. 18, 2003

(86) PCT No.: PCT/DK03/00834

§ 371 (c)(1),
(2), (4) Date: Jul. 14, 2005

(87) PCT Pub. No.: WO2004/057914

PCT Pub. Date: Jul. 8, 2004

(65) Prior Publication Data

US 2006/0115097 A1 Jun. 1, 2006

(30) Foreign Application Priority Data

Dec. 20, 2002 (DK) ..... 2002 01988

(51) Int. Cl.
*H04R 25/00* (2006.01)

(52) U.S. Cl. ..... 381/313; 381/92

(58) Field of Classification Search ..... 381/92, 381/94.1, 71.11, 71.12, 312, 313, 314, 317, 381/320, 321, 355, 356, 357, 358, 91, 122
See application file for complete search history.

(56) References Cited

U.S. PATENT DOCUMENTS

| | | | | |
|---|---|---|---|---|
| 4,773,095 | A | 9/1988 | Zwicker et al. | |
| 5,473,701 | A | 12/1995 | Cezanne et al. | |
| 7,020,290 | B1 * | 3/2006 | Ribic | 381/92 |
| 2002/0034310 | A1 * | 3/2002 | Hou | 381/92 |

FOREIGN PATENT DOCUMENTS

| | | |
|---|---|---|
| EP | 1017253 | 7/2000 |
| WO | 0065873 | 11/2000 |
| WO | 0195666 | 12/2001 |
| WO | 0197558 | 12/2001 |
| WO | 0203750 | 1/2002 |

* cited by examiner

*Primary Examiner*—Huyen Le
(74) *Attorney, Agent, or Firm*—Dykema Gossett PLLC

(57) ABSTRACT

Hearing aid with a microphone system for providing a directional response by generating a fixed forward pointing directivity pattern and a fixed backward pointing directivity pattern and where the forward and backward directivity pattern signals are mixed at a ratio, which ensures energy minimization of the output signal, and where the fixed directivity patterns are set for optimized directivity when the microphone system is located near or at an object.

7 Claims, 4 Drawing Sheets

MICROPHONE SYSTEM WITH DIRECTIONAL RESPONSE

AREA OF THE INVENTION

The invention concerns microphone system for providing a directional response and a method for providing a directional response from a microphone system.

BACKGROUND OF THE INVENTION

In state of the art hearing aids various degrees of directionality is standard. The directionality is normally based on a time delay between the arrivals of the sound at two or more sound openings. The delay originating from the distance between microphones is matched with a delay created in the signal processor or the delay introduced by means of a mechanical delay device within the microphone for the case of dual port microphones. The delays are designed in accordance with free field considerations and the presence of the head is not taken into account when designing the algorithms for directionality.

Known systems for fixed directionality are designed according to the least sensitivity to sounds coming from non-frontal directions under the assumption that the head does not influence the sound field. Also conventional adaptive directivity is working to minimize the acoustic noise entering the hearing aid under free field conditions by means of adaptive variations in the directivity pattern of the hearing aid as proposed Elko in U.S. Pat. No. 5,473,701. Hence, when a hearing aid user is fitted with hearing aids in both ears, the conventional directivity is intended to minimize the acoustic noise in each ear.

SUMMARY OF THE INVENTION

The purpose of the invention is to reduce the noise signal and to give the hearing aid user a more meaningful sense of direction of the unwanted sound according to the binaural experience associated with the use of two hearing aids.

The hearing aid with the microphone system according to the invention provides a directional response by generating a fixed forward pointing directivity pattern and a fixed backward pointing directivity pattern. The system adapts to the incoming sounds. Hence, the forward and backward directivity pattern signals are mixed at a ratio, which ensures energy minimization of the output signal under the prevailing acoustic conditions. The fixed directivity patterns used are optimized according to the presence of the physical shape of a human head, as described below. The adaptive adjustment of the mixing ratio can be controlled by a Least Means Square or Normalized Least Mean Square controller or by another algorithm serving the same purpose. Such a dynamic adjustment according to energy minimization is suggested in U.S. Pat. No. 5,473,701

According to the invention, the directionality parameters are designed according to an analysis of the influence of the head on the acoustic field. The directionality can in general be created by a digital delay or by a more general DSP processing algorithm in the form of a FIR or IIR filter. When the head is taken into account when setting these filters, they will provide directionality with optimal performance, when the hearing instrument is worn by the user.

When the optimization is performed with the presence of the head, an acoustic problem arises in which the influence of the head is not the same in the forward and backward directions. This is due to the head shape in combination with the position of the hearing aid microphones. This means that the forward pointing free field directivity pattern may in general be different from the backward pointing free field directivity pattern.

The optimization may be carried out by means of a numerical model in a computer. Hereby the sound pressure at the positions of the hearing aid microphones when unwanted sound is arriving from different directions is calculated and the influence of the head is taken into account. On the basis of such acoustic calculations the fixed forward and backward directional algorithms are determined in such a way that the adaptive system is able to create as pronounced minima as possible when sound is coming from a number of representative directions. The backward and forward pointing fixed directional systems are optimized according to the best compromise over sound source directions and frequencies.

The proposed optimal forward and backward pointing directivity patterns may in general be frequency dependent. Allowing for such a frequency dependence further increases the complexity of the solution but also creates the possibility of performing an optimization in different frequency bands individually. Hereby the system is allowed to fully compensate for the frequency dependent nature of the acoustic scattering due to the presence of the human head.

The present invention will improve the noise suppression when the unwanted signal is on the shadow side of the head. That means that the hearing aid closest to the noise source or unwanted sound coming from side or rear will attenuate this sound as in a conventional adaptive hearing aid and that the hearing aid turning away from the source will have improved attenuation of the noise or unwanted sound. The hearing aid user thus gets a better idea of the position of the source, and he would for instance know better which way to turn to in order to bring the source into the looking direction in order to listen to the sound.

DESCRIPTION OF A PREFERRED EMBODIMENT

The difference between the present invention and previous methods is the use of a priori knowledge of the acoustic influence of the head. In the preferred embodiment the acoustic influence of the head is predetermined from acoustic computer simulations for the geometry of a normal adult human. The geometry of the head used in numerical computer simulations may be more or less simplified.

Figure 1:
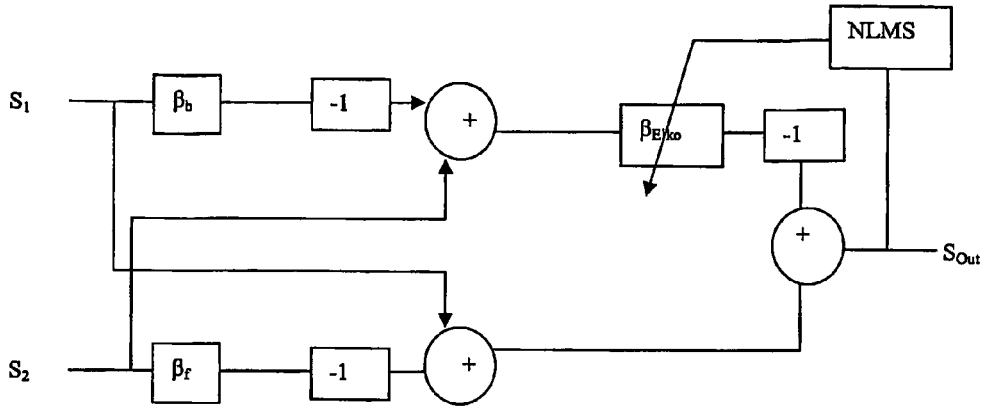
FIG. 1. General layout of one embodiment of adaptive system.

In FIG. 1 General layout of an adaptive system using a Normalized Least Mean Squares algorithm is shown. The $\beta_b$ and $\beta_f$ parameters, representing the ratio between internal and external time delay, is set to unity in the Elko system. In the present simple embodiment of the invention these values are changed in accordance with the presence of the head. Values of $\beta_b$=1.6 and $\beta_f$=1.8 are used in, but frequency dependent values may also be applied. The system comprises an array of two microphones and the following mathematical functions describe the forward directional pattern, $D_f$ and the backward directional pattern, $D_b$, respectively, $$D_f=|s_1-s_2\exp(-jkd\beta_f)|$$

$$D_b=|s_2-s_1\exp(-jkd\beta_b)|$$

where $s_1$ is the signal from the front microphone and $s_2$ is the signal from the rear microphone. k is the wavenumber, d is the distance between microphones and $\beta_f$ determines the characteristic of the forward pointing directivity pattern and $\beta_b$ determines the characteristics of the backward pointing directivity pattern. In the prior art Elko algorithm both the $\beta_f$ and the $\beta_b$ parameter is unity which will give ordinary cardioid patterns. Below it is explained how the parameters $\beta_f$ and the $\beta_b$ are determined in order to provide a directivity pattern, which when the hearing aid is placed on the head gives optimal directivity. The hearing aid will not provide optimum directivity in a free field with the determined parameters, but this is not relevant, because the hearing aid is supposed to function on the head.

The directivity patterns providing the optimal performance when located in a hearing aid mounted on a head (either behind the ear hearing aid or in the ear hearing aid) are found from computer simulations of the acoustic pressure distributions for the geometry of a normal adult human head.

The directivity pattern representing optimum directivity when the acoustic influence of the head is taken into account is determined as follows: The wanted sound is taken to come from directly in front of the hearing aid user and the unwanted sound is assumed to arrive from directions in the rear hemisphere. The parameter to be maximized is the ratio between wanted and unwanted sound pressure. Considerations are usually restricted to the horizontal plane, however. According to the adaptive nature of the directivity, the sound coming from the rear hemisphere can be assumed to always enter through the minimum in the directivity pattern. This is due to the minimization of the acoustic pressure entering the hearing aid by means of dynamic adjustment of the directional pattern through the mixing ratio of the fixed directional signals shown in FIG. 1 as $\beta_{Elko}$. Hence, the optimization is obtained for a specific frequency by determining the parameters $\beta_f$ and $\beta_b$ characterizing the static directional patterns pointing forward and backward so that the adaptive system is able to create as pronounced minima as possible averaged over angles of incoming sound. Hence, for a single frequency a comparison between front to rear signal amplitudes is made for a number of directions of the incoming unwanted sound signal from the rear (for instance taking the angles from 90 to 270 degrees in 5 degree steps) while the amplitude weighting between the two fixed directional systems is adjusted according to minimum sensitivity for each direction of incoming sound, thus imitating the action of the well known adaptive procedure e.g. as proposed by Elko. This analysis is carried out for a wide range of possible $\beta_f$ and $\beta_b$ values and the pair of β-values leading to the most pronounced minima is selected. The procedure is repeated for a number of frequencies. For each frequency results are obtained in terms of $\beta_f$ and $\beta_b$. These frequency dependent values can be used in a highly frequency selective system or they can be used in an average sense according to a suitable weighting function representing the relative importance of different frequency bands with respect to speech intelligibility.

The proposed directional filters can not compensate for the left-right asymmetry caused by the presence of a human head close to the hearing aid, but they can, however, optimize the overall directivity pattern in terms of frequency dependent measures such as DI (directivity index) or a weighted summation thereof; a typical example being an AI-DI measure.

According to the above example numerical sound field calculations are carried out by means of considerations of the geometry of an average human head and used for the optimization of all hearing aids. Another possibility is to make individual measurements of the sound field of each user as part of an advanced hearing aid fitting procedure. This could be done by in situ measurements of the sound pressure variations measured in the hearing aid as a result of changes in the direction of the incoming sound. The $\beta_f$ and $\beta_b$ values may then be adjusted according to the individually measured results.

Figure 2:
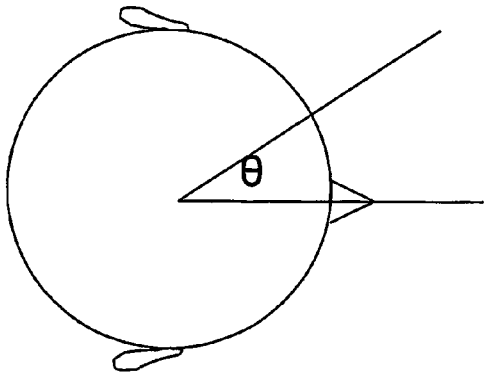
FIG. 2. Sketch of head geometry. Top view of head with sound arriving from the direction θ, left ear assumed to be positioned at 90°
Figure 3:
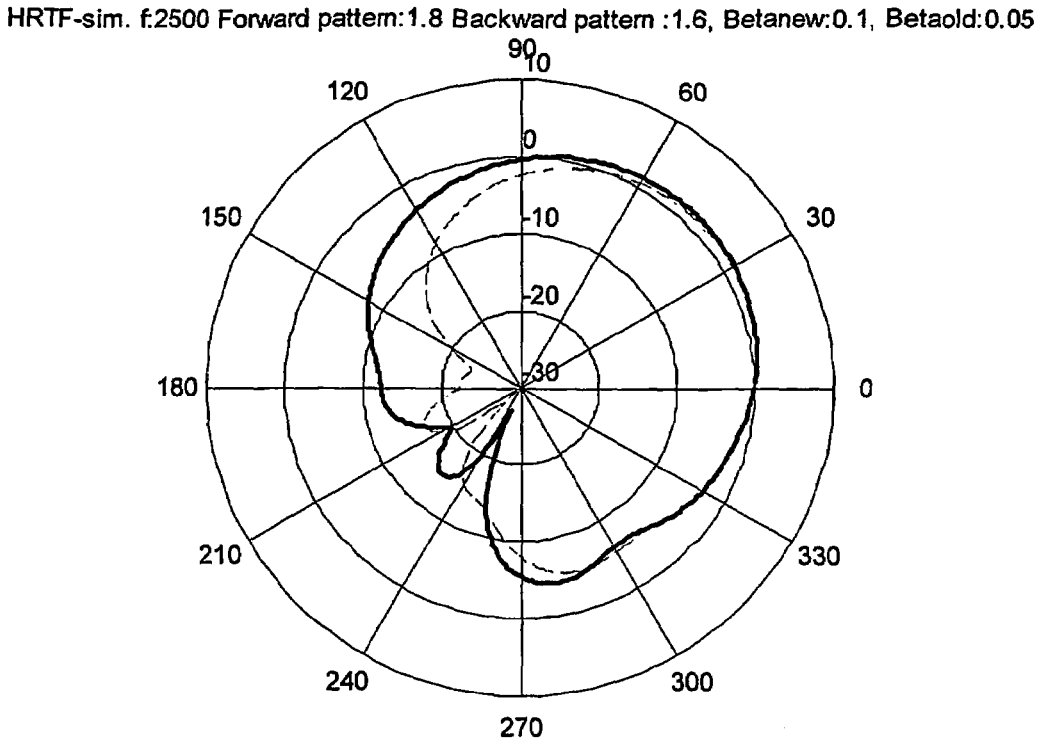
FIG. 3. Calculation of directional performance at 2500 Hz. Dashed curve: Standard adaptive method; Full curve: head taken into account. Unwanted sound from 240 degrees.
Figure 4:
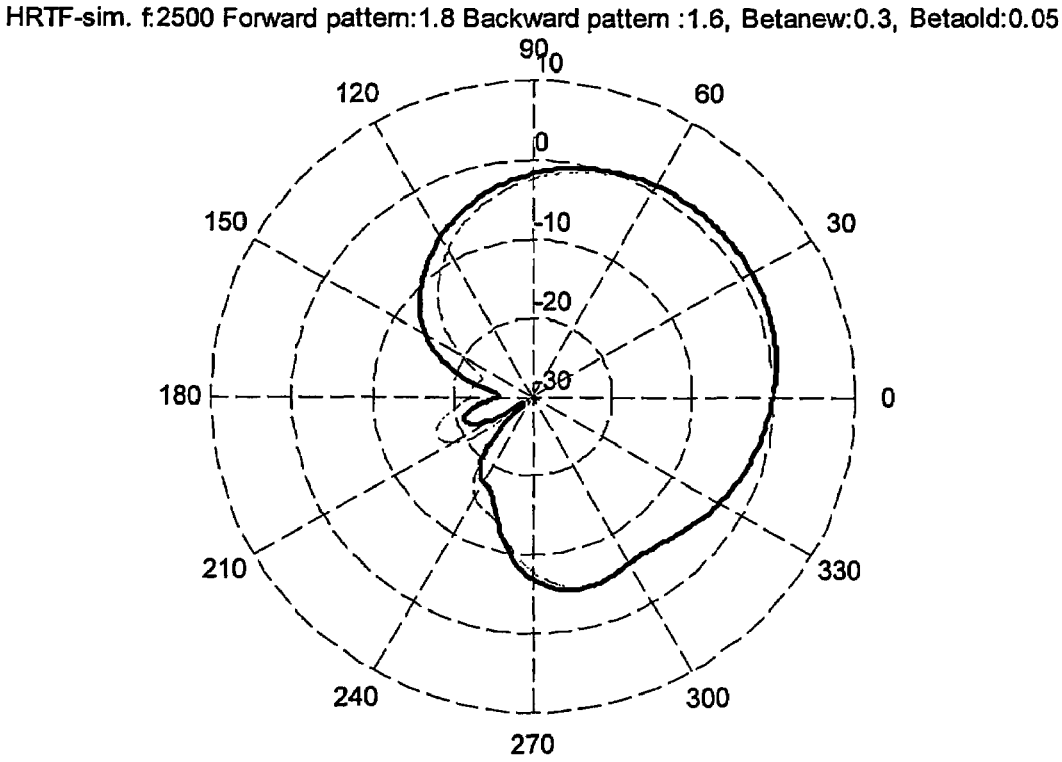
FIG. 4. Calculation of directional performance at 2500 Hz. Dashed curve: Standard adaptive method; Full curve: head taken into account. Unwanted sound from 180°
Figure 5:
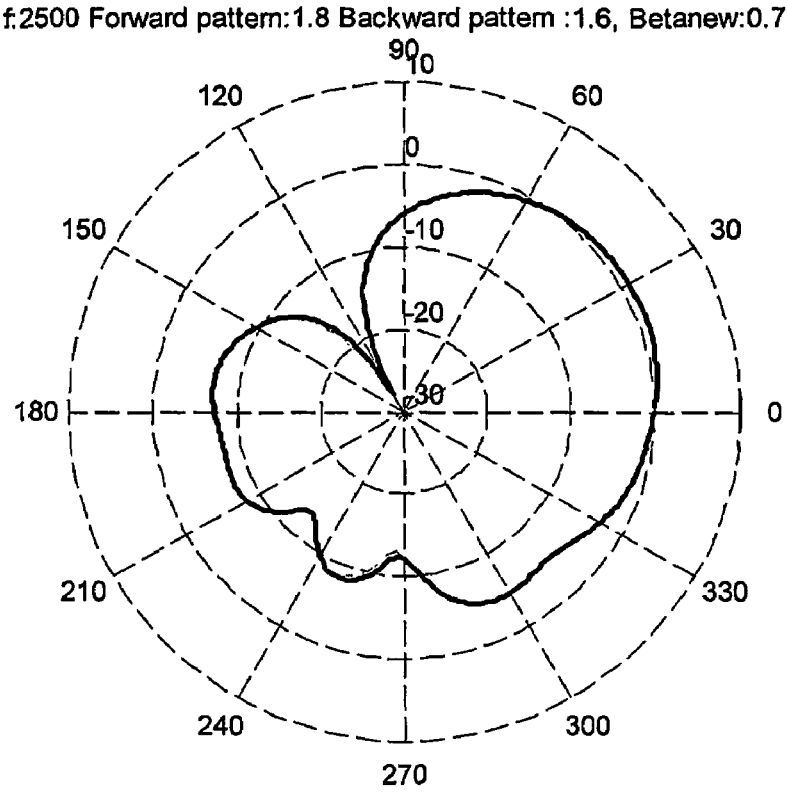
FIG. 5. Calculation of directional performance at 2500 Hz. Dashed curve: Standard adaptive method; Full curve: head taken into account. Unwanted sound from 120°

FIG. 2 shows a sketch of a simplified head seen from above with sound arriving from the direction θ. The examples shown in FIGS. 3, 4 and 5 are analysed for left ear assumed to be positioned at 90° and using a spherical model representing the acoustic influence of the head for the frequency 2500 Hz. The results are based on the new adaptive directional approach using the same $\beta_f$ and $\beta_b$ values for all frequencies. In FIGS. 3, 4 and 5 the dashed curve is directional response of the system using standard adaptive method and full curve is response when the head is taken into account. The unwanted sound si coming from 240° in FIG. 3, 180° in FIG. 4 and 120° in FIG. 5. The direction 0° is in front of user in all three cases. The figures show an improved attenuation except in the case of 120 degrees where the curves merge into one single curve. This indicates that the directional performance may be unchanged compared to conventional adaptive directional systems when the source of unwanted sound is visible from the position of the ear in question. In contrast, the directional performance is improved considerably when the head is blocking the unwanted sound from travelling directly to the ear in question. The head is influencing the sound by this screening effect and thus making it very useful to take the influence of the head into account.

The proposed system increases the listening comfort of the hearing aid user due to an improved realism of the incoming sound levels from unwanted sound sources. In a conventional adaptive directional system the levels will be well attenuated in the hearing aid closest to the source of unwanted sound whereas the levels will be poorly attenuated on the shadow side of the head with respect to this sound source and this will lead to a confusing listening experience. This problem is alleviated considerably by the proposed system.

The invention claimed is:

1. Method for providing a directional response in a hearing aid comprising generating a fixed forward pointing directivity pattern and a fixed backward pointing directivity pattern, and mixing the forward and backward directivity pattern signals at a ratio, which ensures energy minimization of an output signal, and where the fixed directivity patterns are set for optimized directivity when the hearing aid is located near or at an object.

2. Method as claimed in claim 1, wherein the object is the hearing aid user's head.

3. Method as claimed in claim 1, wherein the fixed directivity patterns are set to ensure the highest possible ratio between sound coming from directly in front of the hearing aid user and unwanted sound from behind the user.

4. Method as claimed in claim 1, wherein the optimal forward and backward pointing directivity patterns are generated in a number of frequency bands.

5. Method for adjusting the directional response of a microphone system which is to function at or near an object whereby the microphone system is placed near or at the object or a model of the object, a preferred direction is chosen whereafter the following steps are performed: a. subjecting the microphone system to sound inputs from various directions, b. adjusting the response from the microphone system in order to achieve the highest possible ratio between sound coming from the preferred direction of the microphone system and unwanted sounds coming from other directions where the directional response is achieved by adjusting a delay between the microphone signals and subtracting or adding the signals, c. repeating a and b for a number of different frequencies.

6. Method as claimed in claim 5, whereby the microphone system has two omnidirectional microphones.

7. Method as claimed in claim 5, whereby the microphone system has two omnidirectional microphones and where the directional response is achieved by passing the microphone signals through analog to digital conversion and subsequent Finite Impulse Response (FIR) or Infinite Impulse Response (IIR) filters before subtracting or adding the signals.

* * * * *